United States Patent [19]

Wolfe et al.

[11] Patent Number: 4,473,738

[45] Date of Patent: Sep. 25, 1984

[54] METHOD AND APPARATUS FOR HOT FORMING A POLYGONAL HEAD ON A SNAP TIE ROD

[75] Inventors: Charles R. Wolfe, Miamisburg; Ivan C. Eltzroth, Franklin, both of Ohio

[73] Assignee: Dayton Superior Corporation, Miamisburg, Ohio

[21] Appl. No.: 308,300

[22] Filed: Oct. 5, 1981

[51] Int. Cl.³ ..... B21J 5/08; B21K 1/46

[52] U.S. Cl. ..... 219/152; 10/27 H; 219/151

[58] Field of Search ..... 219/149, 150 R, 151, 219/152; 10/27 H; 72/318

[56] References Cited

U.S. PATENT DOCUMENTS

| | | | |
|---|---|---|---|
| 1,420,970 | 6/1922 | Cornell, Jr. | 72/318 |
| 3,021,421 | 2/1962 | Orgill | 219/150 R |
| 3,783,462 | 1/1974 | Steffan | 219/152 X |

FOREIGN PATENT DOCUMENTS

| | | | |
|---|---|---|---|
| 247602 | 2/1926 | United Kingdom | 219/150 R |

*Primary Examiner*—Roy N. Envall, Jr.
*Assistant Examiner*—Catherine Sigda
*Attorney, Agent, or Firm*—Biebel, French & Nauman

[57] ABSTRACT

An apparatus for hot forming a polygonal head on an end of a tie rod includes a split electrode for gripping a tie rod and a reciprocating electrode for deforming the tie rod end. One of the electrodes defines a die cavity having walls forming a polygonal contour and a depth greater than a predetermined thickness of the tie rod head to be formed, and the other electrode includes a boss positioned in registry with the die cavity such that the boss may enter the cavity upon movement of the reciprocating electrode into abutment with the split electrode, thereby forcing the heated end of a tie rod into the polygonal contour of the cavity. The preferred method includes intermediate steps of lightly gripping the rod by the split electrodes and lightly contacting the rod tip by the reciprocating electrode to locate the rod accurately with respect to the die cavity.

10 Claims, 12 Drawing Figures

METHOD AND APPARATUS FOR HOT FORMING A POLYGONAL HEAD ON A SNAP TIE ROD

BACKGROUND OF THE INVENTION

1. Field of the Invention

The present invention relates to methods and apparatus for forming heads on the ends of metal rods, and more particularly, to methods and apparatus for hot forming or upsetting ends of snap tie rods into polygonal shapes.

2. Prior Art

Tie rods or "snap ties" are used to hold concrete form panels in place during the time the concrete is poured between the forms and hardens. Preferably, the tie rods are made of a metal rod having enlarged heads formed on its ends and a pair of notches formed along its length. To remove the protruding ends from the hardened concrete form, a tool such as a pair of pliers is used to grasp a head and twist it, which snaps the rod end off at the closest notched portion.

In order to minimize manufacturing cost of such tie rods, it is necessary to mass produce them. A well-know method of forming heads on the ends of a tie rod consists of gripping the rod near an end between halves of a split electrode with sufficient force to prevent relative movement, contacting the rod tip adjacent the end with a second electrode, heating the rod end by passing a current from one electrode through the rod end to the other electrode, and then urging the electrodes towards each other to deform or hot upset the end.

A disadvantage with this type of apparatus is that the electrodes do not shape the head as it is being formed. Consequently, the type of head formed has a generally round contour and is irregularly shaped. It often is not concentric with the axis of the tie rod. Such irregularly formed heads are difficult to grasp with tools at the time the end of the tie rod is to be snapped off the remainder, and the non-concentric position of the head increases the likelihood that the head itself is snapped off the tie rod when gripped by a tool, leaving a portion of the rod end protruding from the hardened concrete casting.

In order to provide a tie rod having regularly formed heads capable of being grasped by tools, the electrodes have been provided with recesses into which the rod ends are deformed during the upsetting process. For example, in U.S. Pat. No. 3,783,462, an apparatus for forming pentagonal heads on the ends of tie rods is disclosed. This apparatus comprises a gripper electrode having opposing jaws defining a central bore, and a reciprocating electrode having a recess defined by walls forming a pentagonal contour and a floor forming a heading tip. A tie rod is placed into the apparatus and gripped by the gripper electrode such that an end of the rod protrudes from the gripper electrode toward the reciprocating electrode. The recess in the reciprocating electrode is substantially concentric with the axis of the rod. The reciprocating electrode is brought into contact with the tip of the rod end, the rod end is heated by passing an electrical current through it from one electrode to the other, and the reciprocating electrode is brought into abutment with the gripper electrodes, thereby deforming the rod end into the pentagonal recess of the reciprocating electrode. The reciprocating electrode is retracted, the gripper electrodes are separated, and the tie rod having a pentagonal head is removed from the apparatus.

A problem inherent in apparatus and methods of the type previously described is that it is difficult to cause the heated rod end to flow into an electrode die recess having a polygonal shape such that it assumes the polygonal shape of the recess with sufficient accuracy to enable the finished head to be gripped by a tool such as a pliers or socket wrench. In particular, the metal which flows into the recess to form the head is under insufficient pressure to force it into the corners of the polygonal contour. The result is a head having a generally polygonal contour but with rounded corners. Efforts to increase the pressure acting upon the heated metal within the recess by forcing a greater volume of metal into the recess have resulted in excessive flash formed about the periphery of the finished head. Such flash is caused by the overflow of metal from the recess and makes it difficult if not impossible to grasp the formed head with a tool.

Accordingly, head upsetting apparatus having polygonal recesses have been limited to forming triangular, square, or pentagonal heads since only in these shapes are the angles formed by the intersection of the sides sufficiently accurately defined to enable the finished head to be grasped by a tool even though the corners of the head are rounded. Indeed, in the aforementioned patent, the statement is made that with heads having six or more sides, the finished head is so nearly round that it cannot be reliably gripped with a socket wrench.

An additional problem encountered in such apparatus utilizing die recesses having polygonal shapes is that due to the rapid cycle time and relatively loose tolerances of the electrodes, the tie rod is often positioned off-center prior to the heating and upsetting steps. As a result, the tie rod may be urged against a wall of the polygonal recess, resulting in a malformed tie rod head or the chipping of the die recess.

Accordingly, there is a need for a method and apparatus for forming polygonal heads on a tie rod in which the polygonal head formed is sufficiently accurate to be grasped by a tool with sufficient force to snap the end of the tie rod from the remainder without slippage of the tool with respect to the head. In addition, there is a need for an apparatus for forming polygonal tie rod heads which is capable of accurately locating the tie rod with respect to the die recess to prevent damage to the die recess during the forming operation.

SUMMARY OF THE INVENTION

The present invention provides a method and apparatus for forming a polygonal tie rod head in which the end of a heated tie rod is forced into a polygonal die cavity with sufficient pressure to form a finished head capable of being gripped by a tool. Such accuracy can be maintained for forming polygonal heads including hexagonal shaped heads. In addition, the method of the invention provides steps for the accurate location of the tie rod prior to its being firmly gripped by a gripper electrode and contacted by a reciprocating electrode.

In the method of the invention, a first electrode grips a tie rod adjacent one end and prevents relative movement of the rod with respect to the first electrode, a second electrode is brought into contact with the tip of the rod end, an electric current is passed between the electrodes to heat the rod end to a forging temperature, and the electrodes are brought together to deform the rod end. The invention includes the steps of urging the heated rod end into a die cavity formed in one of the electrodes and having walls defining a polygonal shape, and urging a raised boss on the other electrode into the die cavity to a sufficient depth to compress the heated rod end into the polygonal shape of the die cavity.

Utilizing a raised boss on one of the electrodes enables the heated rod end to be properly deformed under sufficient pressure to force it into the corners of the polygonally shaped die cavity. The raised boss is generally cylindrical in shape and has a diameter across its face which enables it to enter the polygonal die cavity completely without contacting the walls forming the polygonal shape. The height of the boss, measured from the face of the electrode body to which it is attached, is determined by the depth of the cavity and the desired thickness of the head to be formed. Accordingly, the height of the boss is approximately equal to the depth of the cavity less the desired thickness of the finished tie rod head.

In the preferred method, the first electrode first grips the rod relatively lightly and the rod tip is urged lightly against the second electrode, by moving the rod with respect to the first electrode. These initial steps, which precede the step of tightly gripping the rod by the first electrode, accurately locate the rod with respect to the electrodes prior to the high pressure gripping and forming steps, thereby reducing the likelihood of electrode damage by an improperly gripped rod.

Although the polygonal die cavity may have a variety of shapes and still fall within the scope of the invention, the preferred shape is a regular hexagon. A regular hexagonal finished head of appropriate dimensions may be grasped by a wide variety of wrenches, pliers, and socket tools.

In a preferred embodiment of the invention, the first electrode is a split electrode consisting of mating electrode halves, each defining one-half of the die cavity. In addition, the halves also define a bore concentric with the cavity and sized to grip and enclose a tie rod when the halves are brought together. It is desirable that the cavity and bore be formed symmetrically with respect to the electrode halves; that is, one electrode should define a half-hexagonal cavity and half-bore identical in shape to the cavity and bore formed in the other.

With the split electrode provided with the die cavity and bore, the removal of the finished head from the die is facilitated. Since the split electrode halves are separated subsequent to the upsetting step, the finished head is lifted away from the apparatus rather than withdrawn in an axial direction from a one-piece electrode die cavity. In the preferred embodiment, the finished rod is also urged forward and away from the split die by a relatively low-powered, double-acting cylinder.

Another advantage in forming the die cavity in the split electrode is that it facilitates the location of the rod end with respect to the die. Because the bore is concentric with the die cavity formed in the split electrode, the rod is gripped between the electrode halves such that the rod end which protrudes through the cavity is necessarily concentric with respect to the cavity. Thus there is no need to provide special means for accurately locating the tip of the rod end into a polygonal die cavity on an electrode opposing the gripping electrode.

The boss of the preferred embodiment carried on the reciprocating electrode opposite the gripping electrode is frusto-conical in shape, having a flat circular outer face normal to the axis of the rod end. The converging wall of the boss is preferably at an angle of 45° to the face of the reciprocating electrode. This beveled edge prevents the tie rod from "hanging up" or resting upon an edge of the boss as it is placed into the apparatus prior to being gripped by the split electrode. If a rod should be placed into the apparatus of the invention so that the rod tip comes down upon and engages the edge of the boss, the beveled contour will enable the rod tip to slide downwardly until the rod is positioned in registry with the flat face of the boss.

In an alternate embodiment, the polygonal die cavity is formed in the reciprocating electrode, and the raised boss is mounted on the split electrode. In order to facilitate the proper location of the rod end with respect to the polygonal cavity in this embodiment, the floor of the recess is provided with a "dimple" or concavity, located concentrically with respect to the die cavity, and sized to receive the tip of the rod. The raised boss is in the form of two semi-cylindrical members which are curved around the central bore of the split electrode and extend outwardly from its face. Each semi-cylindrical member is mounted on a separate one of the electrode halves so that the raised boss is symmetric about a plane dividing the electrode halves.

In operation, the split electrode halves are urged together to grip a tie rod adjacent one end. The rod tip is brought into contact with the dimple on the reciprocating electrode, and the rod end is heated to a forging temperature electrically. The reciprocating electrode is brought into pressure engagement with the split electrode, and the heated end is thereby upset into the polygonal die cavity. The raised boss, which forms a collar about the tie rod adjacent the rod end when the tie rod is gripped by the split electrode, enters the cavity and forces the heated metal of the rod end to flow into the corners of the polygonal cavity.

Accordingly, it is an object of the present invention to provide a method and apparatus for forming tie rod heads which prompts formation of polygonal heads rapidly and with consistently acceptable quality; to form heads which can be of a hexagonal shape without corners so round that the heads cannot be grasped by a tool; and to provide a method and apparatus in which the tie rod can be accurately located prior to the forging step, thereby prolonging the life of the electrodes and reducing the rate of rejection.

Other objects and advantages of the invention will be apparent from the following description, the accompanying drawings, and the appended claims.

DESCRIPTION OF THE PREFERRED EMBODIMENTS

Figure 1:
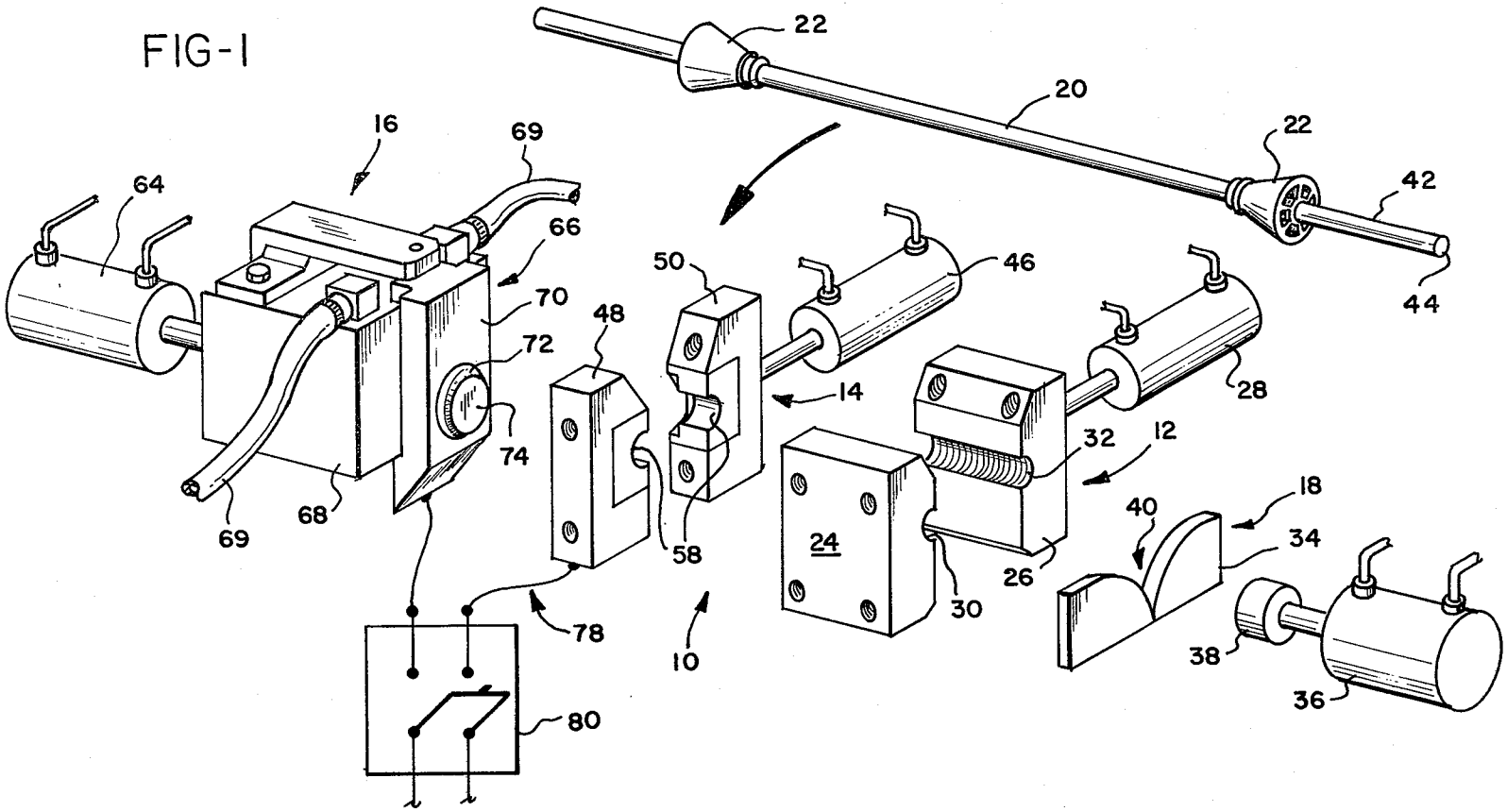
FIG. 1 is a perspective view schematically illustrating the apparatus of the invention.

As shown in FIG. 1, the apparatus of the invention, generally designated 10, consists of pneumatically operated power grippers 12, a split or gripper electrode 14, a reciprocating electrode 16, and locating or positioning apparatus 18. The apparatus 10 is designed to receive an unfinished tie rod 20 which has already been fitted with plastic cones 22 which cover crimped frangible notches (not shown).

The power gripper 12 consists of mating members 24, 26 which are formed of a hard steel, for example S-5 tool steel, and are actuated by a double-acting pneumatic cylinder 28. Each mating member 24, 26 defines one-half of a through bore 30, 32 sized to receive the rod 20.

The positioning apparatus 18 includes a V-groove 34 and a double-acting pneumatic cylinder 36 which positions a ram 38. The V-groove 34 includes a notch 40 for positioning the end 42 of the rod 20 so that its tip 44 is in registry with the ram 38.

Figure 3:
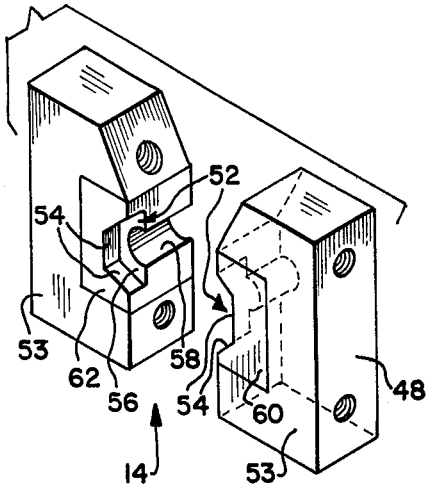
FIG. 3 is a perspective view of the split electrode of the preferred embodiment.

The gripper electrode 14 is actuated by a double-acting pneumatic cylinder 46 and consists of mating electrode halves 48, 50. As shown more clearly in FIG. 3, the electrode halves 48, 50 are symmetric about a vertical plane passing through a longitudinal axis of a tie rod supported within the V-groove 34. Each electrode half 48, 50 defines a mating half of a hexagonal die cavity 52 which is formed in a face 53 of the electrode 14 and is bounded by walls 54 and a floor 56. Similarly, each electrode half 48, 50 defines one-half of a through bore 58 which is positioned concentrically with respect to the cavity 52.

The electrode halves 48, 50 are preferably made of a highly conductive yet hard metal. Preferably, the inserts 60, 62 wherein the die cavity and bore 58 are formed are made of a hard, conductive alloy such as Anviloy 1100. "Anviloy" is a registered trademark of P. R. Mallory & Co., Inc., Indianapolis, Ind. The remainder of the electrode halves 48, 50 may be made of copper.

Figure 2:
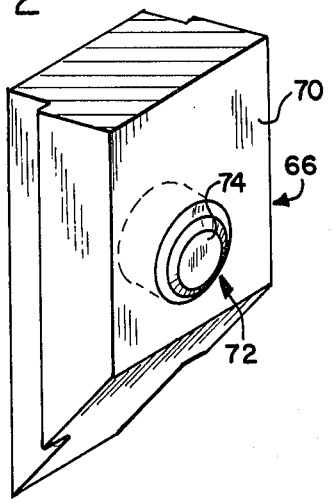
FIG. 2 is a perspective view of a portion of the reciprocating electrode of the preferred embodiment.

As shown in FIGS. 1 and 2, the reciprocating electrode 16 is actuated by a double-acting cylinder 64 and consists of an electrode body 66 and support apparatus 68. Support apparatus 68 preferably is water cooled and includes coolant supply hoses 69. The electrode body 66 includes a flat base 70 having a raised boss 72 extending outwardly therefrom and positioned in registry with the die cavity 52 of the closed die halves 48, 50. The raised boss 72 includes a flat face 74 and is generally frustoconical in shape, having a beveled side wall 76 sloped at an angle of approximately 45° to the base 70.

The boss 72 is preferably part of a plug 77 press fitted into the electrode body 66. The plug is made of a hard, conductive alloy such as Mallory 100. "Mallory" is a trademark for an alloy manufactured by the aforementioned P. R. Mallory & Co., Inc. The electrode body may be made of copper.

The boss 72 has a diameter such that it may be inserted entirely into the die cavity 52 of the die halves 48, 50 when the split electrode 14 is in a closed position and the halves abut each other. For example, in the preferred embodiment, the width of the hex die cavity 52 is approximately 0.449 inches, measured from a face 54 to an opposite face 54, when the electrode is in the closed position. The boss 72 is approximately 0.440 inches in diameter at its widest portion, measured in a plane containing the boss 70, and is approximately 0.420 inches in diameter measured across its flat face 74. The height of the boss 72 is approximately equal to the depth of the die cavity 52, less the desired thickness of the tie rod head to be formed.

For example, in the preferred embodiment in which the desired thickness of a tie rod head is 0.125 inches, the depth of the die cavity 52 would be approximately 0.135 inches, and the height of the raised boss 72 approximately 0.010 inches. Thus when the electrode body 66 is brought into contact with the split electrode 14 such that the base 70 abuts the face 53 of the split electrode 14, the raised boss 72 is inserted completely into the die cavity so that the cavity is completely covered, save for the area immediately adjacent the corners of the hexagonal shape at the intersection of the walls 54.

As shown in FIG. 1, the electrode body 66 and split electrode 14 are parts of a circuit 78 having a remotely controlled switch 80 and connected to a power source (not shown).

Figure 4:
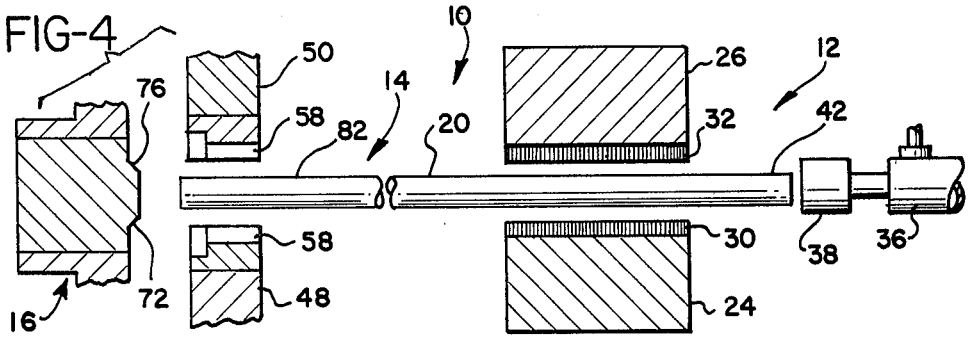
FIGS. 4, 5, 6, 7, and 8 are plan views, in section, sequentially illustrating the method of the preferred embodiment of the invention.

The method of the invention is illustrated in FIGS. 4-8. In FIG. 4, the rod 20 is placed by mechanical means (not shown) in the apparatus 10 so that one end 42 of the rod is supported by the V-groove 34 (FIG. 1), and an opposite end 82 is positioned between the split electrode halves 48, 50, which have been moved to an open position by their double-acting cylinder. At this time, the mating members 24, 26 of the power gripper 12 are also in the open position to allow placement of the rod 20. The reciprocating electrode 16 and ram 38 have been retracted by their respective cylinders to provide sufficient clearance for the rod 20 to be placed in the apparatus 10. Should the rod 20 be placed in the apparatus 10 so that the rod end 82 rests upon the side wall 76 of the boss 72, the beveled contour of the wall would cause the end to slide downwardly so that the rod would rest properly between the electrode halves 48, 50.

Figure 5:
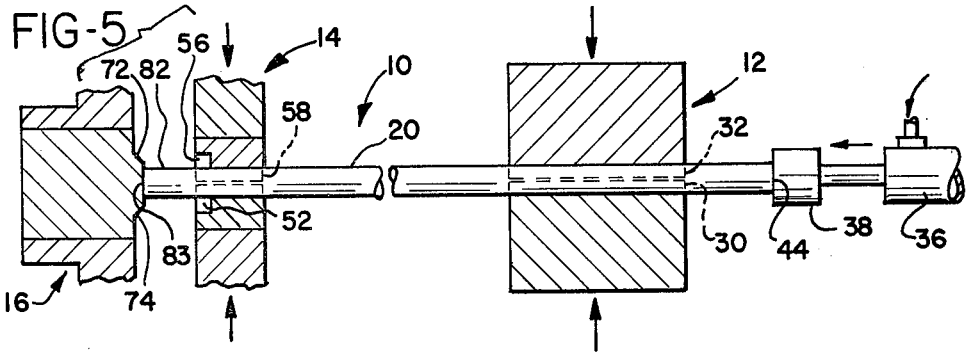

As shown in FIG. 5, the next step of the method consists of a brief cycling of the cylinders actuating the split electrode 14 and power gripper 12 such that the grippers lightly engage the rod 20 so that it is positioned and lightly gripped within the bore 58 and is lightly gripped by the through bore halves 30, 32. This brief cycling of cylinders 46, 28 provides a locating function. In the preferred embodiment, the pressure exerted by the grippers 14, 12 is only a fraction of that exerted during later steps of the method.

Following this light gripping action, the cylinder 36 is activated, forcing the ram 38 toward the power grippers 12, preferably with a force of about 20 pounds. Ram 38 contacts the rod tip 44 and urges the rod 20 toward the boss 72 on the reciprocating electrode 16, where the tip 83 contacts the flat face 74 of the boss 72.

The rod 20 is now accurately located with respect to the apparatus 10. Since the rod end 82 which now extends from the boss 72 to the floor 56 of the cavity 52 will constitute the metal which is upset into the rod head, the distance between the face 74 and the floor 56 is determinative of the volume of metal upset. Therefore, it is critical to position the rod 20 accurately with respect to the boss 72 and cavity 52 to prevent an insufficient or excessive amount of metal from being upset into the finished head. In the preferred embodiment, the travel of the electrode is approximately 0.406 inches, so that the distance from the face 74 to the floor 56 is approximately 0.541 inches.

Figure 6:
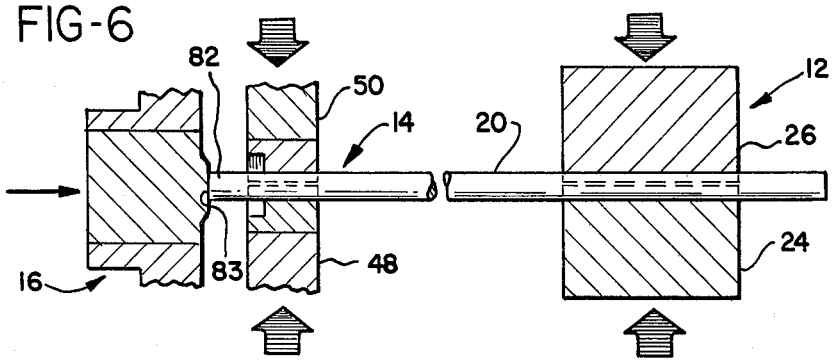

The next step is shown in FIG. 6. After location of the rod 20 has been effected, the ram 38 remains against rod tip 44, and the power grippers 12 are compressed against the rod to fix it firmly in place. In the preferred embodiment, the cylinder 28 is activated to urge the mating members 24, 26 together with approximately 2,500 pounds of force. At the same time, the gripper electrode 14 is urged together so that its mating halves 48, 50 tightly grip the end 82 of the rod 20 in place.

The reciprocating electrode 16 is now urged forward by cylinder 64 with a low pressure, thereby forming an adequate electrical connection across the tip 83 of the rod 20. In the preferred embodiment, the pressure exerted is approximately 1,200 pounds. Next, a current is passed between the reciprocating electrode 16 and the gripper electrode 14 through the rod end 82, thereby heating the rod end to a forging temperature.

Figure 7:
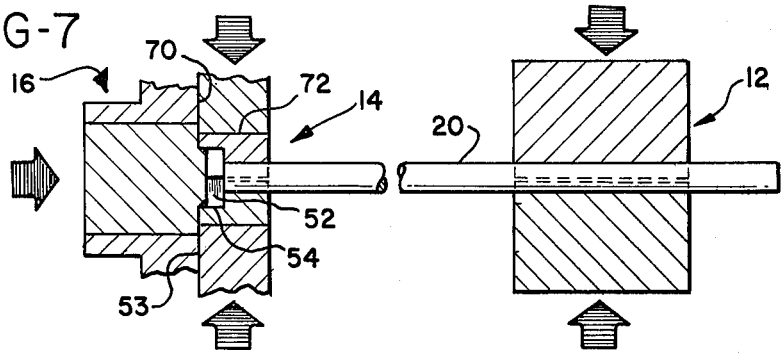

As shown in FIG. 7, the next step in the method is to urge the reciprocating electrode 16 toward the split electrode 14 until the face 70 abuts the face 53 of the split electrode. The boss 72 enters completely into the die cavity 52, thereby forcing the rod end 82 to conform to the hexagonal shape of the cavity. The entry of the boss 72 causes the heated metal to flow into the corners of the hexagonal shape defined by the walls 54. In the preferred embodiment, the cylinder 64 urges the reciprocating electrode 16 forward against the gripper electrode 14 with approximately 3,200 pounds of force.

Figure 8:
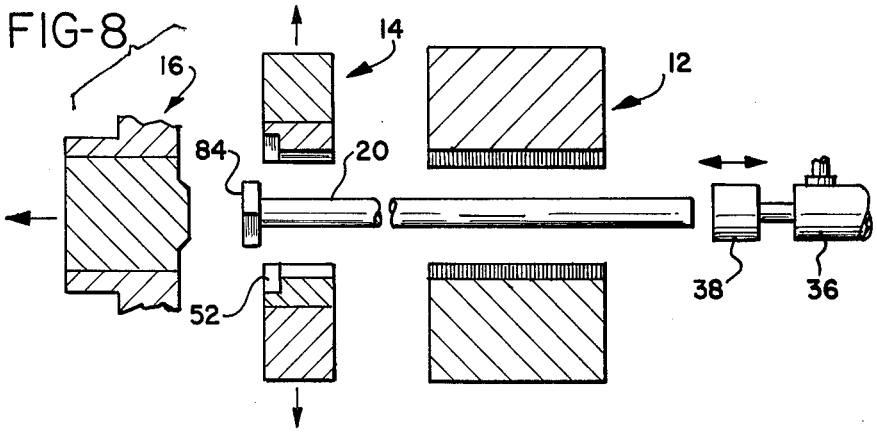

The final step of the preferred method, shown in FIG. 8, consists of separating the power gripper 12 and gripper electrode 14, and withdrawing the reciprocating electrode 16 from the finished head 84 of the rod 20. Since the cavity 52 is in the gripper electrode 14, the removal of the rod 20 from the cavity 52 is facilitated by the separation of the two halves of the cavity. After the grippers 12, 14 and reciprocating electrode 16 have been withdrawn from the rod 20, it may be removed and an unfinished rod placed within the apparatus. The removal of the rod 20 from the die cavity 52 is aided by a longitudinal displacement of the rod by ram 38 toward the boss 72 as the gripper electrode 14 and the grippers 12 are loosened. The cylinder 36 is then cycled to withdraw ram 38 from the tip 44 of the rod 20.

Figure 9:
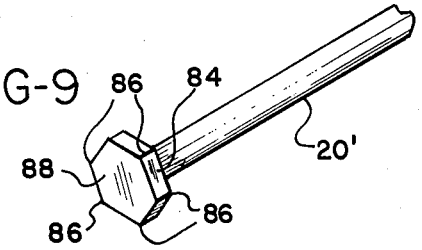
FIG. 9 is a perspective view of the finished head of a tie rod made in accordance with the invention.

The finished rod 20′ is shown in FIG. 9 having a hexagonal shaped head 84. The use of a raised boss on the reciprocating electrode forces the heated metal into the corners of the die cavity to produce a finished head having sharper corners 86 than heads formed with other methods. There is a minimum of flash produced since the cavity in the gripper electrodes is completely covered by the base of the electrode body and the entry of the boss into the cavity.

Figure 10:
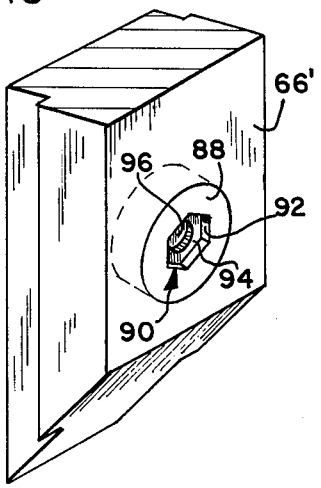
FIG. 10 is a perspective view of a portion of a reciprocating electrode of an alternate embodiment of the invention.
Figure 11:
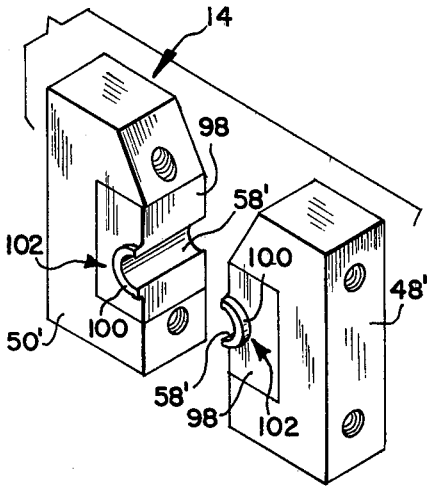
FIG. 11 is a perspective view of a split electrode of the alternate embodiment.

An alternate embodiment of the invention is shown in FIGS. 10 and 11. FIG. 10 shows the electrode body 66′ of a reciprocating electrode (not shown) having an insert 88 defining a hexagonal die cavity 90 bounded by walls 92 and a floor 94. Located concentrically in the floor 94 is a dimple or recess 96 which is of approximately the same diameter as the end of a rod to be upset. The dimple 96 is utilized to center the rod end as the rod is urged into the cavity 94 during the locating step of the method of the invention. As in the preferred embodiment, the insert 88 preferably is formed of a hard yet highly conductive alloy such as Elkonite TC53. Elkonite is a Registered Trademark of the aforementioned P. R. Mallory & Co., Inc.

FIG. 11 shows an alternate gripper electrode 14′ consisting of mating electrode halves 48′, 50′, each having an insert 98 defining one-half 58′ of a through bore. In addition, each half 48′, 50′ defines a crescent-shaped half 100 of a raised boss 102. The halves 100 are positioned about the periphery of the through bore 58′ and are raised from the face of the gripper electrode 14 and extend toward the opposing electrode body 66′. The insert 98 preferably is made of a hard, conductive material such as Anviloy 1000, manufactured by the aforementioned P. R. Mallory & Co., Inc.

Figure 12:
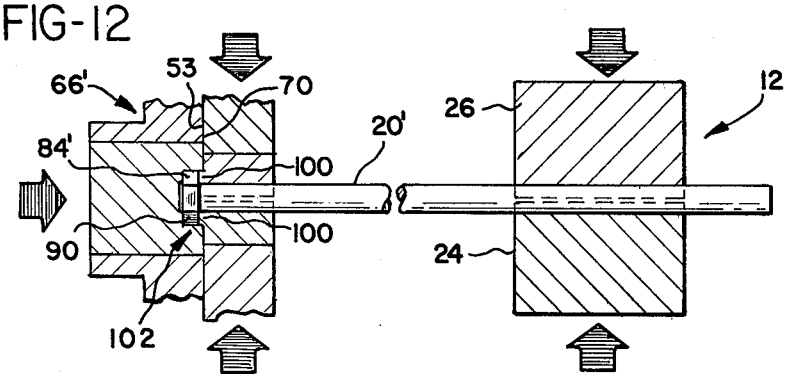
FIG. 12 is a plan view, in section, of a step in the method of the invention in which the alternate embodiment of the apparatus is used.

The steps of the method of the invention are the same when the alternate embodiment, utilizing the electrode body 66′ and gripper electrode 14′, is employed. However, the upsetting step occurs as shown in FIG. 12. In the upsetting step, the reciprocating electrode, which carries the electrode body 66′, is brought into abutment with the gripper electrode 14′ so that the base 70′ of the electrode body is against the base 53 of the gripper electrode. At this time, the boss 102, formed of the two half bosses 100, enters the die cavity 90 to urge the heated metal of the end of the rod 20′ into the hexagonal shape. After the formed head 84′ of the rod 20′ has cooled sufficiently, the electrode body 66′ is withdrawn from the gripper electrode 14′, thus removing the finished head from the die cavity 90, and the gripper electrode 14′ is separated for removal of the finished rod therefrom.

While the methods and forms of apparatus herein described constitute preferred embodiments of this invention, it is to be understood that the invention is not limited to these precise forms of apparatus and methods, and that changes may be made therein without departing from the scope of the invention.

What is claimed is:

1. A method for hot forming a hexagonal head, adapted to be grasped by conventional tools, on an end of a metallic rod comprising the steps of:

gripping said rod near its end between mating halves of a split electrode, said halves defining a die cavity having walls forming a hexagonal contour and defining a bore concentric with said cavity such that said rod extends through said bore and said rod end extends through said cavity, said cavity having a depth exceeding an intended thickness of said head to be formed;

urging against the tip of said rod end a second electrode having a raised boss oriented concentrically with said cavity and having an outside diameter sufficiently less than that of said cavity to avoid contacting said cavity walls when inserted therein, and having a height approximately equal to a depth of said cavity less an intended thickness of said head, said boss including a substantially flat face positioned to contact said rod tip;

heating said rod end to forging temperature by passing an electric current therethrough with said split and second electrodes; and upsetting said rod end into said die cavity by urging said second electrode against said split electrode such that said boss enters said cavity and forces said heated rod end to flow into corners of said cavity such that said end accurately assumes said hexagonal shape.

2. A method of hot forming a hexagonal head, adapted to be grasped by a conventional tool, on an end of a metallic rod comprising the steps of:

gripping said rod near its end between mating halves of a split electrode, each of said halves including a semi-cylindrical member forming one-half of a raised boss concentric with said gripped rod;

urging against the tip of said rod end a second electrode defining a die cavity having walls defining a hexagonal shape and a floor which contacts said rod tip, said cavity oriented concentrically with said boss and having an outside diameter sufficiently greater than that of said boss to avoid contact with said boss when receiving said boss therein, and having a depth approximately equal to a height of said boss plus an intended thickness of said head;

heating said rod end to forging temperature by passing an electric current therethrough with said split and second electrodes; and upsetting said rod end into said cavity by urging said second electrode against said split electrode such that said boss enters said cavity and forces said heated end to flow into corners of said cavity such that said end accurately assumes hexagonal shape.

3. The method of claim 2 further comprising the steps of:

partially closing said split electrode halves about said rod prior to said gripping step to allow relative movement of said rod; and displacing said rod tip into a concavity in said floor and concentric with said cavity in said second electrode to locate said rod with respect to said cavity.

4. The method of claim 1 or 2 further comprising the steps of:

seperating said second electrode from said split electrode after said upsetting step;

seperating said mating halves of said split electrode and;

urging said rod toward said second electrode simultaneously with said step of separating said mating halves so that said rod may be removed.

5. The method of claim 1 further comprising the step of locating said rod in registry with said boss prior to said gripping step.

6. The method of claim 5 wherein said locating step comprises the steps of:

partially closing said split electrode halves about said rod prior to said gripping step to allow movement of said rod relative to said split electrode; and displacing said rod tip against said raised boss subsequent to said partial closing step and prior to said gripping step.

7. In an apparatus for hot forming a hexagonal head, adapted to be grasped by a conventional tool, on an end of a metallic tie rod, the improvement comprising:

a split electrode for gripping a rod and including a pair of electrode halves, each having substantially half of a cavity having walls defining a hexagonal shape and a depth greater than an intended thickness of a hexagonal head to be formed, and a bore concentric with said cavity and shaped to receive a tie rod therein;

a second electrode having a raised boss positioned thereon to be concentric with said cavity, said boss having a flat face, a height approximately equal to said cavity depth less an intended thickness of a hexagonal head, and a diameter sufficiently less than a diameter of said cavity to avoid contacting said walls when inserted therein; and means for reciprocating said second electrode between a position spaced from said split electrode to a forming position in contact with said split electrode such that said boss enters said cavity sufficiently to force a heated rod end to flow into corners of said cavity to assume said hexagonal shape.

8. The apparatus of claim 7 wherein said boss has a frustoconical shape.

9. In an apparatus for hot forming a hexagonal head, adapted to be grasped by a conventional tool, on an end of a metallic tie rod, the improvement comprising:

a split electrode for gripping a rod and including a pair of electrode halves, each having substantially half of a raised, annular boss and a bore concentric with said boss and extending through said boss and said electrode halves and shaped to receive a tie rod therein;

a second electrode having a cavity, concentric with said boss, with walls forming a hexagonal shape, a depth substantially equal to a height of said boss plus an intended thickness of a hexagonal head, and a diameter greater than that of said boss sufficiently to avoid contact therewith when receiving said boss therein; and means for reciprocating said second electrode between a position spaced from said split electrode to a forming position in contact with said split electrode such that said boss enters said cavity sufficiently to force a heated rod end to flow into corners of said cavity to assume said hexagonal shape.

10. The apparatus of claim 9 wherein said second electrode includes a concavity in a floor of said cavity and concentric with said hexagonal walls thereof, said concavity sized to receive an end of a tie rod therein.

* * * * *

UNITED STATES PATENT AND TRADEMARK OFFICE

CERTIFICATE OF CORRECTION

PATENT NO. : 4,473,738

DATED : September 25, 1984

INVENTOR(S) : Charles R. Wolfe and Ivan C. Eltzroth

It is certified that error appears in the above-identified patent and that said Letters Patent is hereby corrected as shown below:

Col. 5, line 37, after "die cavity" insert --52--.

Col. 6, line 1, "boss" should be --base--.

Col. 9, line 34, "seperating" should be --separating--.

Col. 9, line 36, "seperating" should be --separating--.

Signed and Sealed this

*Second* Day of *April 1985*

[SEAL]

*Attest:*

DONALD J. QUIGG

*Attesting Officer* *Acting Commissioner of Patents and Trademarks*